United States Patent [19]

Brown et al.

[11] 4,194,380

[45] Mar. 25, 1980

[54] CORRUGATED ELLIPTICAL WAVEGUIDE WITH PERMANENT TWIST

[75] Inventors: Fred Brown, Calumet City; Anthony D. Vinezeano, Markham, both of Ill.

[73] Assignee: Andrew Corporation, Orland Park, Ill.

[21] Appl. No.: 963,389

[22] Filed: Nov. 24, 1978

Related U.S. Application Data

[62] Division of Ser. No. 811,053, Jun. 29, 1977, Pat. No. 4,144,510.

[51] Int. Cl.[2] ..... B21D 11/14

[52] U.S. Cl. ..... 72/64; 72/371

[58] Field of Search ..... 72/64, 65, 371; 333/95 A

[56] References Cited

U.S. PATENT DOCUMENTS

| | | | |
|---|---|---|---|
| 240,984 | 5/1881 | Farmer | 72/371 |
| 2,260,779 | 10/1941 | Huffmen | 72/371 |
| 2,800,705 | 7/1957 | Ingall et al. | 72/371 X |
| 3,520,165 | 7/1970 | Dodson | 72/64 |

*Primary Examiner*—Leon Gilden

*Attorney, Agent, or Firm*—Leydig, Voit, Osann, Mayer & Holt, Ltd.

[57] ABSTRACT

A corrugated elliptical waveguide comprises a unitary, fluid-impervious, corrugated metallic tube with a substantially elliptical cross section. The corrugated tube is permanently twisted about its longitudinal axis for connecting two terminals having their E planes out of register with each other. The twist is uniformly distributed along a predetermined length of the corrugated tube. The twist is formed by twisting a corrugated circular waveguide about its longitudinal axis and simultaneously converting the circular cross section to an elliptical cross section, thereby causing the twist to be set in the elliptical waveguide.

6 Claims, 8 Drawing Figures

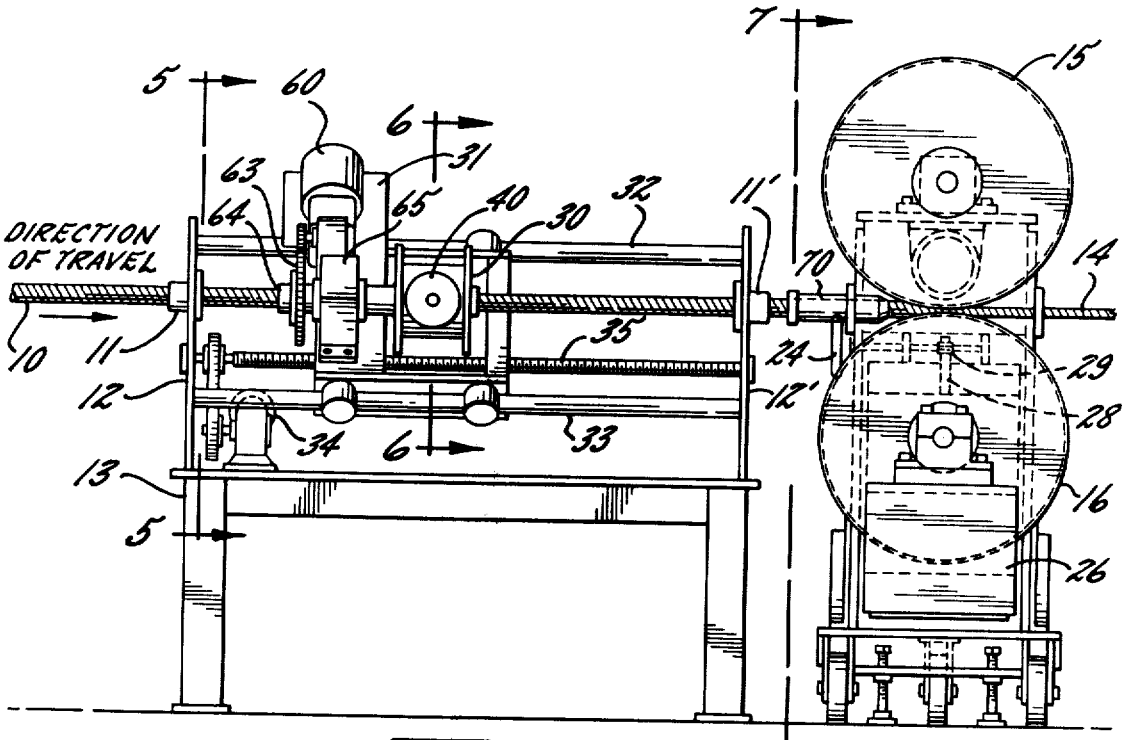
Fig. 1.
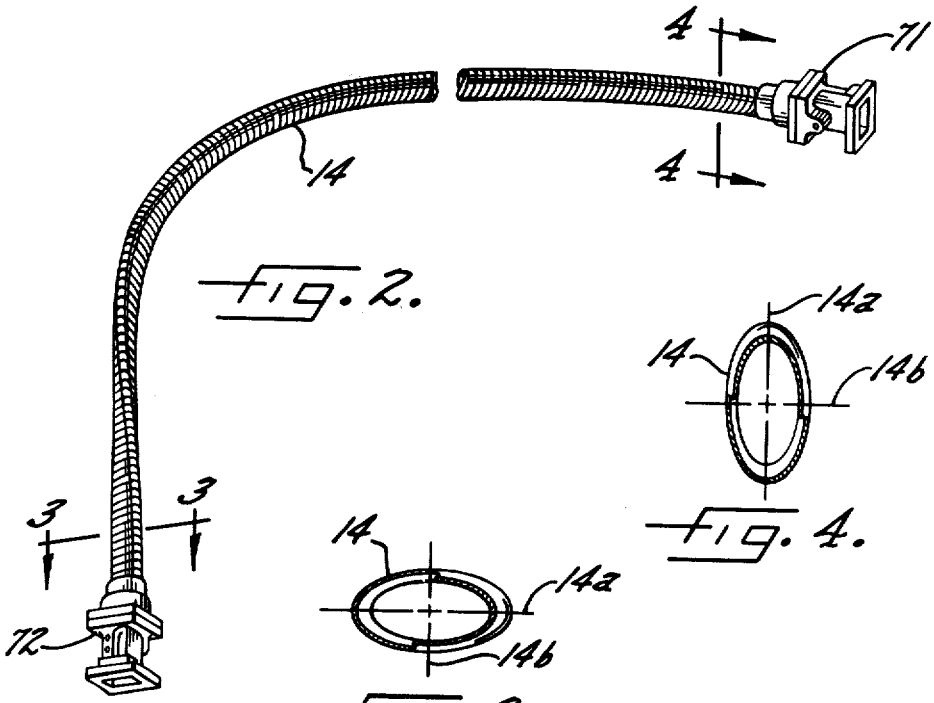
Fig. 2.
Fig. 4.
Fig. 3.

CORRUGATED ELLIPTICAL WAVEGUIDE WITH PERMANENT TWIST

This is a division, of application Ser. No. 811,053, filed June 29, 1977 now U.S. Pat No. 4,144,510, issued Mar. 13, 1979.

DESCRIPTION OF THE INVENTION

The present invention relates generally to waveguides and, more particularly, to corrugated elliptical waveguide for making flexible connections between waveguide terminals that have their E planes out of register with each other.

It is a primary object of the present invention to provide an improved corrugated elliptical waveguide which can be used to interconnect two terminals which are oriented with their E planes out of register with each other, with reference to a common center line. For example, the improved corrugated waveguide of this invention can be used to provide a flexible waveguide connection to an antenna feed horn, which normally has its E plane 90° out of register with the E plane of the waveguide leading to the ground equipment associated with the antenna.

It is another object of this invention to provide such an improved corrugated elliptical waveguide which can be made as a single unitary structure that is impervious to fluids, particularly air and moisture. In this connection, a related object of the invention is to provide such a unitary waveguide that is sufficiently strong that it can be supported with mounting clamps without risking deformation of the walls of the waveguide.

A further object of the invention is to provide an improved corrugated elliptical waveguide of the foregoing type which can be quickly installed using conventional waveguide connectors that can be applied in the field rather than in the factory. A related object of the invention is to provide such a waveguide that does not produce any torsional strain on its end connectors or mounting clamps.

A still further object of the invention is to provide such an improved corrugated elliptical waveguide that can be cut to virtually any desired length in the field, while still providing the requisite angular transition between the out-of-register terminals.

Still another object of this invention is to provide such an improved corrugated elliptical waveguide which can be removed and reinstalled without the necessity of twisting the waveguide to re-align it with the out-of-register terminals each time.

It is a further object of this invention to provide an improved corrugated elliptical waveguide of the type described above which offers good electrical performance characteristics.

Yet another object of this invention is to provide such an improved corrugated elliptical waveguide which can provide the required angular transition between two out-of-register terminals in a relatively short length of waveguide.

A further object of this invention is to provide such an improved corrugated elliptical waveguide which can be efficiently manufactured at a relatively low cost.

Other objects and advantages of the invention will be apparent from the following detailed description and the accompanying drawings.

In accordance with the present invention, there is provided a corrugated elliptical waveguide comprising a single unitary, fluid-impervious, corrugated metallic tube with a substantially elliptical cross section, the corrugated tube being permanently twisted about its longitudinal axis for connecting two terminals having their E planes out of register with each other, the twist being uniformly distributed along a predetermined length of the corrugated tube. There is also provided a method for forming such corrugated elliptical waveguide by twisting a unitary, fluid-impervious corrugated circular waveguide about its longitudinal axis while converting the circular cross-section to an elliptical cross-section.

In the drawings:

FIG. 1 is a side elevation of apparatus for converting circular corrugated waveguide to elliptical corrugated waveguide having a predetermined twist about its longitudinal axis, in accordance with the present invention;

FIG. 2 is a perspective view of a length of twisted-corrugated elliptical waveguide embodying the present invention, with the waveguide bent through an angle of about 90° and with conventional connectors attached to opposite ends of the waveguide;

FIG. 3 is a transverse section taken substantially along line 3—3 in FIG. 2;

FIG. 4 is a transverse section taken substantially along line 4—4 in FIG. 2;

While the present invention is susceptible of various modifications and alternative forms, specific embodiments thereof will be described in detail by way of example with reference to the drawings. It should be understood, however, that it is not intended to limit the invention to the particular forms described, but, on the contrary, it is intended to cover all alternatives, modifications and equivalents following within the spirit and scope of the invention as expressed in the appended claims.

It will be understood that the term "elliptical" as used herein includes any of the more or less oval-shaped configurations commonly called "elliptical" in the waveguide art. It is well known in the art that the term "elliptical" as commonly applied to waveguide is merely an approximation, and is not limited to a shape meeting the mathematical criteria of a true ellipse.

Figure 7:
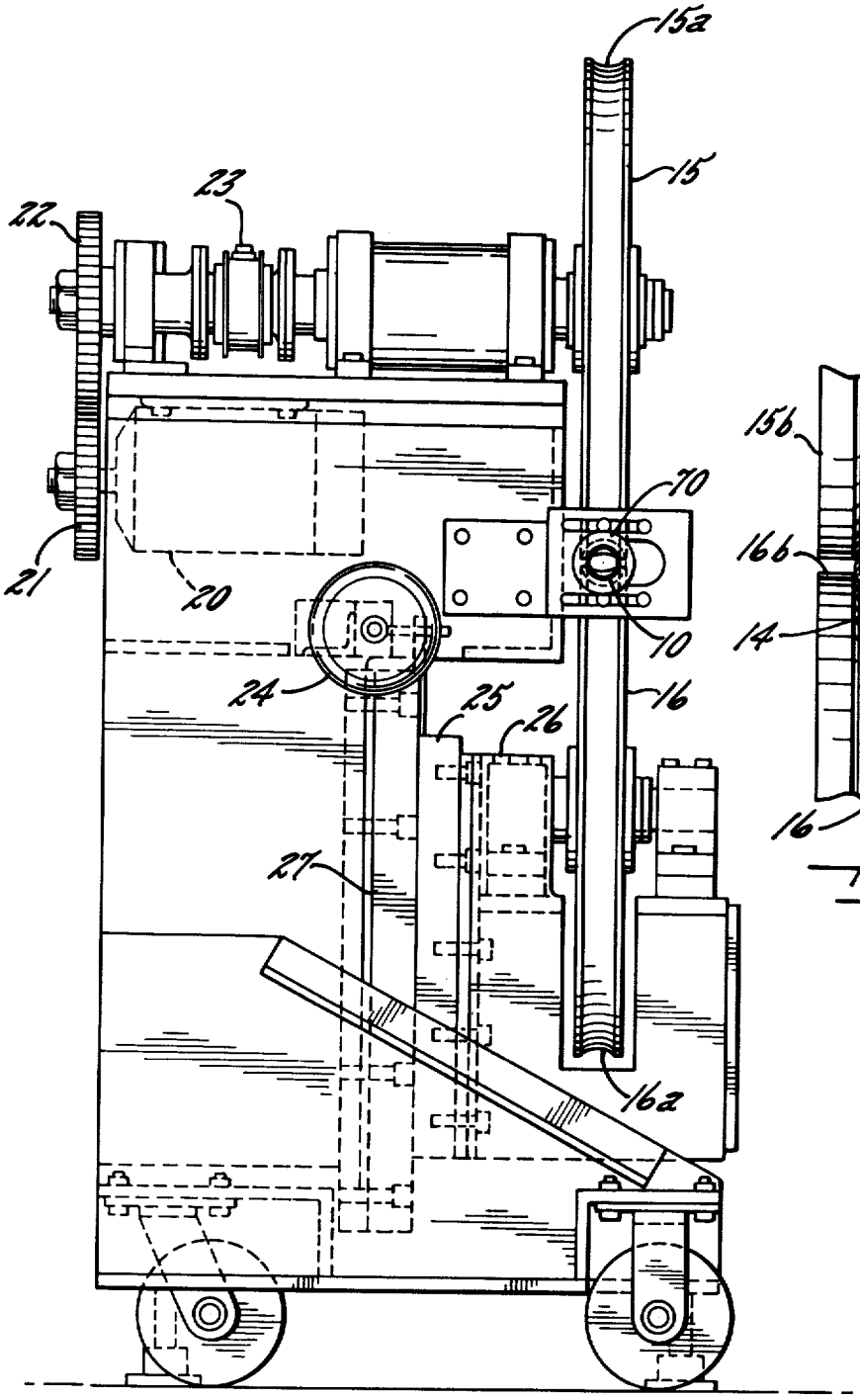
FIG. 7 is an enlarged end elevation showing the right-hand end of the apparatus illustrated in FIG. 1.
Figure 8:
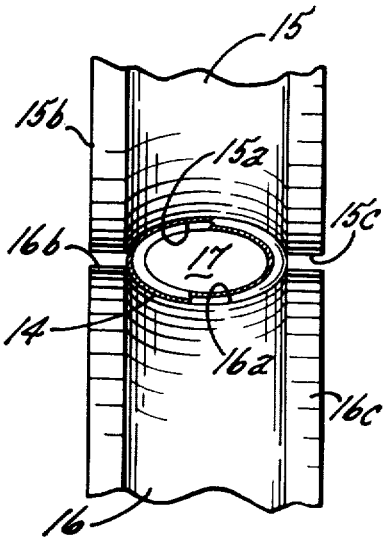
FIG. 8 is an enlarged view of the forming surfaces in the nip of the two forming rolls shown in FIG. 7.

Turning now to the drawings and referring first to FIG. 1, a preformed corrugated circular waveguide 10 is fed into the left-hand end of the illustrative apparatus as viewed in FIG. 1. More specifically, the circular waveguide 10 is fed through a pair of guide collets 11 and 11' mounted in the end plates 12 and 12' of a stationary rigid frame 13. The conversion of this circular waveguide 10 to an elliptical waveguide 14 is effected by a pair of forming rolls 15 and 16 mounted at the right-hand end of the apparatus as viewed in FIG. 1. As shown in FIGS. 7 and 8, the working surfaces of these rolls 15 and 16 are provided with concave central portions **15*a* and 16*a* which define an elliptical opening 17 at the nip of the two rolls. Consequently, as the circular waveguide passes between the two forming rolls 15** and 16, the cross-sectional configuration of the waveguide is changed from circular to elliptical.

For the purpose of advancing the circular waveguide 10 between the two forming rolls 15 and 16, the upper roll 15 is driven by a variable speed motor 20 via gears 21 and 22. To permit adjustment of the space between the two forming rolls 15 and 16, to accomodate waveguide of different sizes, the bottom roll 16 is mounted for vertical movement by means of a hand wheel 24. The turning of this hand wheel 24 raises and lowers the bottom forming roll 16 by effecting vertical movement of a slide 25 which is rigidly fastened to the mounting frame 26 in which the bottom roll 16 is journaled. The slide 25 rides on a rail 27, and is connected to the hand wheel via a rack 28 and pinion 29 (FIG. 1). For precise adustment of the space between the two rolls 15 and 16, a preselected gauge is inserted between the flats 15*b*, 16*b* and 15*c*, 16*c*, and the bottom roll 16 is then raised until the two pairs of flats 15*b*, 16*b* and 15*c*, 16*c* engage opposite sides of the gauge.

After the leading end of the circular waveguide 10 has been inserted between the two forming rolls 15 and 16, the drive motor 20 for the upper forming roll 15 is turned on to initiate advancing movement of the waveguide 10 through the nip of the two rolls 15 and 16, and the concave central portions 15*a* and 16*a* of the working surfaces of the two rolls form the desired elliptical cross sectional configuration for the waveguide 14.

In accordance with one important aspect of the present invention, a preselected portion of the corrugated waveguide is gripped and turned around its axis, while the waveguide is being passed between the forming rolls, to produce a permanent twist in the corrugated elliptical waveguide. It is preferred that this turning of the waveguide be effected upstream of the forming rolls, because it has been found that turning the waveguide downstream of the forming rolls results in a greater degree of springback in the corrugated waveguide after the turning force is released. Also, if the waveguide is twisted downstream of the forming rolls, the waveguide must be twisted at a slower rate and the twist must be distributed over a considerably greater length of waveguide than when the waveguide is twisted upstream of the forming rolls.

Figure 5:
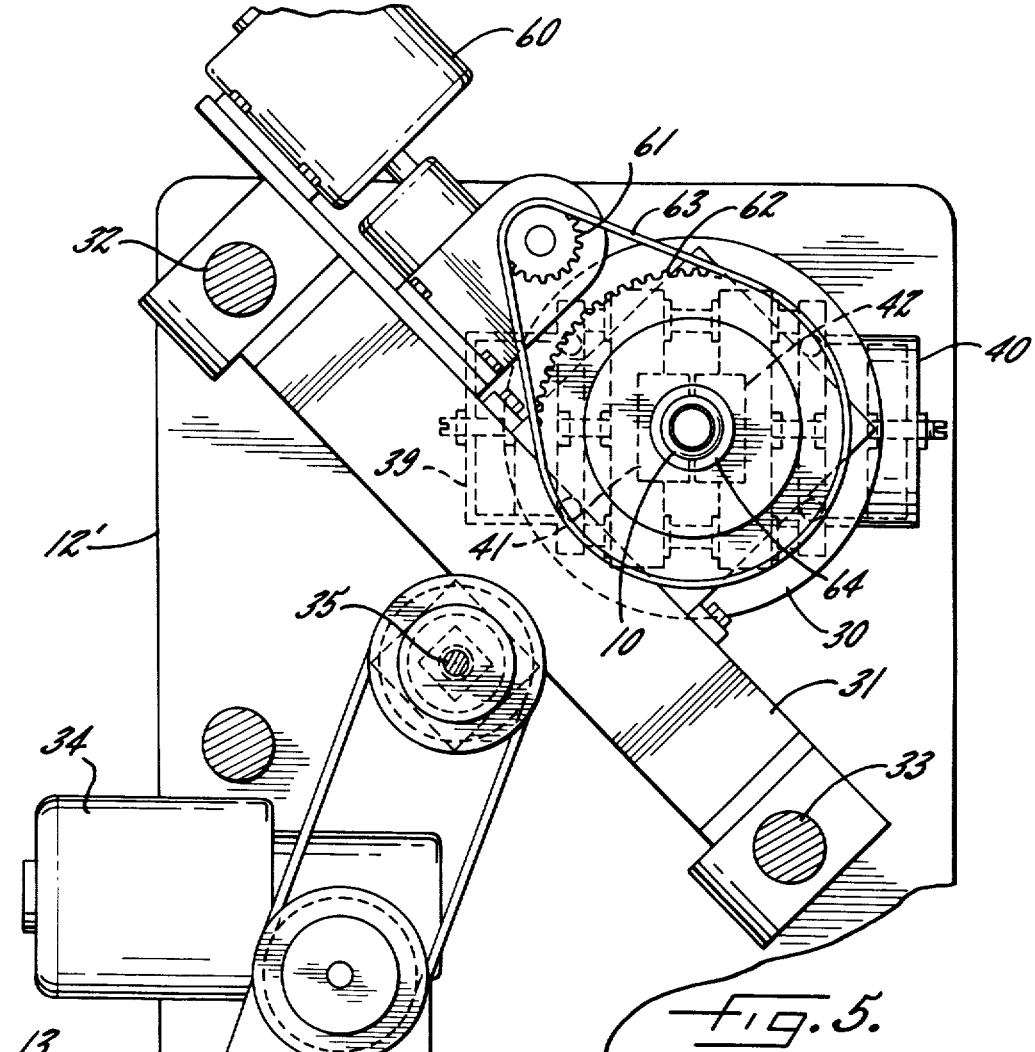
FIG. 5 is an enlarged vertical section taken substantially along line 5—5 in FIG. 1.
Figure 6:
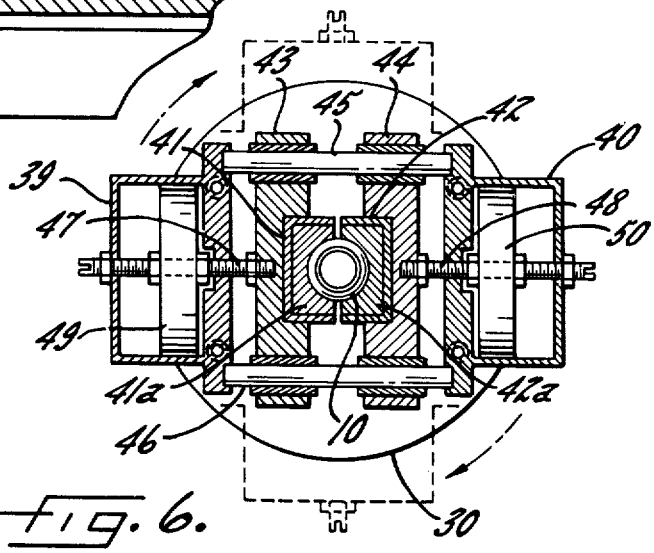
FIG. 6 is an enlarged vertical section taken substantially along line 6—6 in FIG. 1.

Thus, in the illustrative embodiment, the circular waveguide 10 is passed through a twister head 30 upstream of the forming rolls 15 and 16. To permit the waveguide to be gradually twisted while it is being fed through the forming rolls 15 and 16, the twister head 30 is mounted on a carriage 31 which carries the twister head 30 and its drive mechanism along the same linear path followed by the waveguide 10 between the two guide collets 11 and 11'. As can be seen most clearly in FIGS. 1, 5 and 6, the waveguide 10 passes through the carriage 31 and the twister head 30 as the waveguide traverses the span between the two guide collets 11 and 11'. The carriage 31 is mounted on a pair of guide rods 32 and 33 extending between the two end plates 12 and 12' of the frame 13, and is driven by a reversible drive motor 34 which turns an elongated drive screw 35 threaded through the carriage 31. Consequently, energization of the drive motor 34 causes the carriage 31 to traverse the guide rods 32 and 33 in response to rotation of the drive screw 35. The limits of this traversing movement can be controlled by limit switches (not shown) that reverse the drive motor 34 when the carriage 31 reaches its advanced position and de-energize the drive motor 34 when the carriage 31 reaches its retracted position. To ensure that the carriage 31 advances along the guide rods 32 and 33 at the same speed at which the waveguide 10 is drawn through the forming rolls 15 and 16, the two drive motors 20 and 34 are preferably synchronized with each other.

When it is desired to initiate the twisting operation, a pair of pneumatic cylinders 39 and 40 mounted on the twister head 30 are actuated to advance a pair of clamps 41 and 42 into firm engagement with opposite sides of the corrugated waveguide 10. These clamps 41 and 42 are carried in a pair of mounting blocks 43 and 44 riding on a pair of guide rods 45 and 46 formed as a part of the twister head 30. The mounting blocks 43 and 44 are connected to the inner ends of a pair of piston rods 47 and 48 fastened to corresponding pistons 49 and 50 within the respective cylinders 39 and 40. It will be appreciated that the entire clamping assembly, including the pneumatic cylinders 39 and 40, comprises a part of the twister head 30.

When pressurized air is applied to the outer faces of the pistons 49 and 50, the clamps 41 and 42 are advanced into engagement with the corrugated waveguide 10. To protect the relatively thin walls (e.g., 0.020" of the waveguide, the gripping surfaces of the clamps 41 and 42 are formed by a pair of removable inserts 41*a* and 42*a* made of a slightly resilient polymeric material. These inserts can be changed to accomodate waveguides of different sizes, and the outer ends of the piston rods 47 and 48 are slotted to permit adjustment of the piston stroke for the same purpose. As will be apparent from the ensuing discussion, the clamps 41 and 42 are advanced to engage the waveguide 10 at the beginning of each twisting operation when the twister head 30 is in its retracted or left-hand position as viewed in FIG. 1. When the twister head 30 reaches its advanced position at the right-hand end of the guide rods 32 and 33 as viewed in FIG. 1, the clamps 41 and 42 are retracted to release the waveguide by applying pressurized air to the inner faces of the pistons 49 and 50.

After the waveguide 10 has been gripped by the clamps 41 and 42, and while the carriage 31 is traversing toward the forming rolls 15 and 16, a drive motor 60 on the carriage 31 is energized to rotate the twister head 30 at a uniform rate about the longitudinal axis of the waveguide 10. This rotational movement of the twister head 30 rotates the waveguide around its longitudinal axis, against the resistance provided by the pressure of the forming rolls 15 and 16 against the waveguide passing therethrough. In the particular embodiment illustrated, the drive motor 60 turns a sprocket 61 which in turn drives a sprocket 62 by a chain 63. The sprocket 62 is rigidly secured to an elongated hub 64 forming a part of the twister head 30 and journaled in a mounting block 65 forming a part of the carriage 31. Consequently, it can be seen that the twister head 30 is driven around the axis of the advancing waveguide 10, while the carriage 31 carries the twister head 30 along the axis of the waveguide. Energization of the twister head drive motor in 60 can be controlled, either manually or through limit switches, to effect any desired degree of twist in the waveguide.

In general, the twister head 30 must be driven around the waveguide through an angle greater than the angle of permanent twist desired in the waveguide. For example, in most applications a 90° twist is desired, which means that the twister head 30 must be driven more than a full quarter turn around the axis of the waveguide 10. The particular degree of "overtwist" required to achieve any given angle of permanent twist in the final elliptical waveguide depends on the type of metal employed, the wall thickness, the size of the waveguide, etc., and thus varies for different applications. The only twist that is permanently set in the waveguide is that which is effected in the nip of the forming rolls where the waveguide is worked to convert the cross-section from circular to elliptical while the waveguide is being twisted. The resulting permanent twist is uniformly distributed along the same length of waveguide traversed by the carriage 31 during the twisting operation (typically a length of 12" or less).

As the circular waveguide 10 exits from the twister head 30, it passes through the guide collet 11' and then enters a feed tube 70 which leads the waveguide into the nip of the forming rolls 15 and 16. As described previously, the forming rolls 15 and 16 convert the circular cross section of the corrugated waveguide into the desired elliptical cross section. The resulting waveguide 14 emerging from the nip of the forming rolls 15 and 16 not only has an elliptical cross section, but also has a permanent twist. For example, in the exemplary product illustrated in FIGS. 2–4, the elliptical waveguide has been provided with a 90° twist, as can be seen from the 90° displacement of the major and minor axes 14*a* and 14*b* of the ellipse at opposite ends of the waveguide. FIG. 2 also illustrates how the waveguide can be bent around corners due to the corrugations which render the waveguide sufficiently flexible to be bent and yet sufficiently rigid to hold its bent shape.

Corrugated elliptical waveguide has been twisted in situ previously, but such twists have not been permanent and have resulted in torsional springback forces in the twisted waveguide. For example, through the use of special tools, relatively long lengths of corrugated elliptical waveguide have been twisted in situ and then held in the twisted configuration by the end connectors and mounting clamps along the length of the waveguide. This is not only a tedious installation process, but also produces a constant strain on the end connectors and the mounting clamps. Furthermore, waveguide twisted in this manner naturally loses its twist whenever the connectors and clamps are released, and thus the twisting operation has to be repeated each time the waveguide is removed and re-installed.

A more common solution to the problem of connecting waveguide terminals with E planes which are out of register with respect to a common center line, particularly where short lengths are involved, is the use of special articulated rectangular waveguide formed from a helically wrapped interlocking metallic strip. Such articulated waveguide may be twisted by hand because the interlocked segments of strip may slide with respect to each other, rendering the waveguide extremely flexible and twistable. However, such waveguide is quite costly to manufacture; it cannot be mounted with ordinary mounting clamps because such clamps distort the articulated walls of the waveguide; special flanges must be secured to pre-cut lengths of the waveguide in the factory to permit connection of the waveguide to the desired terminals; and the interlocked edges of the articulated segments of the waveguide are not moisture or pressure tight, thereby requiring a rubber-like jacket that is molded over the waveguide after fabrication. Also, the metal surfaces in the sliding joint areas are subject to possible long term surface contamination, resulting in degraded electrical peformance of the waveguide.

As will be appreciated from the foregoing detailed description, the improved waveguide provided by the present invention is a single unitary structure with a permanent twist. Consequently, this waveguide is impervious to moisture and other fluids to maintain good electrical characteristics over a long operating life regardless of whether the waveguide is jacketed; it is sufficiently strong that it can be used with conventional mounting clamps without risking deformation of the walls of the waveguide; it can be quickly installed using conventional waveguide connectors that can be applied in the field rather than in the factory, such as the connectors 71 and 72 illustrated in FIG. 2; it does not require twisting in situ and does not produce a torsional strain on its end connectors and mounting clamps; it can be removed and re-installed without re-twisting the waveguide each time to re-align it with the desired terminals; it is capable of providing any desired degree of twist in a relatively short length of waveguide (e.g., a 90° twist in a 9" to 12" length); and it can be cut to virtually any desired length in the field while still providing the requisite angular transition between the out-of-register terminals.

We claim:

1. A method of converting corrugated circular waveguide to corrugated elliptical waveguide with a permanent twist, said method comprising the steps of (a) passing a single, unitary, fluid-impervious corrugated circular waveguide between a pair of forming tools defining an elliptical cross-sectional opening for converting the circular waveguide passed therethrough to elliptical waveguide, and (b) gripping a preselected portion of the corrugated waveguide and turning that portion of the waveguide around its axis while the waveguide is being passed between said forming tools to form a permanent twist in the elliptical waveguide.

2. A method of converting corrugated circular waveguide to corrugated elliptical waveguide with a permanent twist as set forth in claim 1 wherein said preselected portion of the waveguide that is gripped and turned about its axis is located upstream of said forming tools.

3. A method of converting corrugated circular waveguide to corrugated elliptical waveguide with a permanent twist as set forth in claim 1 wherein said preselected portion of said waveguide is turned about its axis at a substantially uniform rate.

4. A method of converting corrugated circular waveguide to corrugated elliptical waveguide with a permanent twist, said method comprising twisting a unitary, fluid-impervious, corrugated circular waveguide about its longitudinal axis while converting the circular cross-section to an elliptical cross-section.

5. A method of converting corrugated circular waveguide to corrugated elliptical waveguide with a permanent twist as set forth in claim 4 wherein the waveguide is twisted upstream of the area where the waveguide is converted from a circular cross-section to an elliptical cross-section.

6. A method of converting corrugated circular waveguide to corrugated elliptical waveguide with a permanent twist as set forth in claim 4 wherein the waveguide is twisted about its longitudinal axis at a substantially uniform rate.

* * * * *